US008636266B2

(12) United States Patent
Gill

(10) Patent No.: US 8,636,266 B2
(45) Date of Patent: Jan. 28, 2014

(54) SAFETY BARRICADING SYSTEM

(75) Inventor: Shane Gill, Yorktown (AU)

(73) Assignee: Bart's Ltd., Kowloon (HK)

( * ) Notice: Subject to any disclaimer, the term of this patent is extended or adjusted under 35 U.S.C. 154(b) by 106 days.

(21) Appl. No.: 13/197,565

(22) Filed: Aug. 3, 2011

(65) Prior Publication Data

US 2013/0032771 A1 Feb. 7, 2013

(51) Int. Cl.
*E04H 17/16* (2006.01)

(52) U.S. Cl.
USPC ..... 256/24; 256/DIG. 6

(58) Field of Classification Search
USPC ..... 256/24, 27, 73, 65.14, DIG. 6; 160/135; 182/138, 82; 52/454, 664, 63
See application file for complete search history.

(56) References Cited

U.S. PATENT DOCUMENTS

| | | | | |
|---|---|---|---|---|
| 3,480,069 | A | 11/1969 | Handwerker | |
| 3,962,827 | A * | 6/1976 | Chaffee | 49/384 |
| 4,129,197 | A | 12/1978 | Preston | |
| 4,805,735 | A * | 2/1989 | Anderson | 182/138 |
| 4,838,382 | A | 6/1989 | Nusbaum | |
| 4,858,724 | A | 8/1989 | St-Germain | |
| 4,928,929 | A | 5/1990 | Kinder | |
| 5,182,889 | A | 2/1993 | Johnson | |
| D356,380 | S | 3/1995 | Reinklou | |
| D356,644 | S | 3/1995 | Henderson | |
| 5,487,690 | A * | 1/1996 | Stoffle et al. | 446/105 |
| 5,556,080 | A * | 9/1996 | Vise | 256/24 |
| 5,787,955 | A * | 8/1998 | Dargie | 160/368.1 |
| 6,283,456 | B1 * | 9/2001 | Benz et al. | 256/24 |
| 6,367,216 | B1 * | 4/2002 | Maylon | 52/454 |
| 6,371,419 | B1 * | 4/2002 | Ohnuki | 248/74.2 |
| 6,406,003 | B1 * | 6/2002 | Shaw | 256/36 |
| 6,824,122 | B2 * | 11/2004 | Spyrakis | 256/47 |
| 6,932,194 | B1 | 8/2005 | Chipman | |
| 7,730,677 | B2 * | 6/2010 | Hansen | 52/204.5 |
| 7,866,635 | B2 * | 1/2011 | Payne | 256/24 |
| 2006/0151770 | A1 * | 7/2006 | Payne | 256/45 |
| 2006/0180390 | A1 | 8/2006 | Thaler | |
| 2006/0186391 | A1 * | 8/2006 | Hansen | 256/24 |

FOREIGN PATENT DOCUMENTS

| | | |
|---|---|---|
| AU | 2010202985 | 8/2010 |
| EP | 1607551 A1 | 12/2005 |
| EP | 1936072 A1 | 6/2008 |

OTHER PUBLICATIONS

International Search Report for PCT/AU2011/001165, dated Jun. 12, 2011, 3 pgs.

* cited by examiner

*Primary Examiner* — Michael P Ferguson
*Assistant Examiner* — Jonathan Masinick
(74) *Attorney, Agent, or Firm* — Woodard, Emhardt, Moriarty, McNett & Henry LLP

(57) ABSTRACT

The safety barricading system includes at least one mesh panel that is secured against an existing surface, object, or structure via a plurality of uniquely defined clips. The safety barricading system is designed to adaptively attach onto a building or structure in a temporary or permanent basis, and prevent objects from falling there from. The safety barricading system includes tools that remove the clips after use as well as joiner assemblies that abut adjacent sections of mesh panels at varying angles. The uniquely defined clips each include an eccentric pin joiner and mesh clip button that attach to one another as well as onto the respective clip, and sandwich the mesh panel there between so as to secure the mesh panel to the respective clip.

13 Claims, 9 Drawing Sheets

SAFETY BARRICADING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of barricading systems, more specifically, a safety barricade that is installed upon a perimeter of a building or structure and used during or after construction in order to prevent objects from falling off of said building or structure.

In the construction realm there are many safety considerations that arise. This is especially true as it pertains to dropping objects from a building or structure. This is true regardless of whether the building or structure is under construction. What is needed is a system that can be easily installed onto and/or removed from an elevated platform, walkway, or stairway, and which prevents objects from falling there from.

The system as described below seeks to overcome the safety concerns with falling objects by providing a barricading system that can be installed on either a temporary or permanent basis, and which is adaptable for installation upon a plurality of surfaces and objects associated with a building or structure.

B. Discussion of the Prior Art

As a preliminary note, it should be stated that there is an ample amount of prior art that deals with barricading systems generally. However, no prior art discloses a barricading system that can be installed on a temporary or permanent basis for use with a building or structure so as to prevent objects from falling off of an elevated surface or floor; wherein the barricading system includes a mesh panel that clips into a plurality of uniquely defined clips, which support said mesh on or against an object or surface; wherein the plurality of uniquely defined clips are adapted for use with tubular objects, curbed surfaces, elongated edges, or to abut adjacent sections of mesh panels at varying angles; wherein the uniquely defined clips each include an eccentric pin joiner and a mesh clip button that attach onto the uniquely defined clip and which sandwich the mesh panel therein so as to secure the mesh panel to the respective clip; wherein a removal tool is included to aid in detaching the clips from the mesh panels and/or related surfaces.

The Thaler Patent Application Publication (U.S. Pub. No. 2006/0180390) discloses a roof fall protection apparatus that comprises several components that can be easily assembled and disassembled on site and that are adaptable to various building geometries. However, the apparatus requires at least two support members in order to assemble the apparatus thereon, and does not rely upon existing structures, such as hand rails to provide uniquely defined clips that attach to and support a mesh thereon via eccentric pin joiners and mesh clip buttons that sandwich the mesh there between.

The Preston patent (U.S. Pat. No. 4,129,197) discloses a safety-catch scaffolding system adaptable to the progressive growth of a building during construction having a series of spaced uprights, each having a plurality of vertically disposed slots for the sliding engagement of the edges of a plurality of frames. Again, the scaffolding system is not a highly adaptive barricading system that attaches a screen mesh to existing objects or surfaces via uniquely defined clips including eccentric pin joiners and mesh clip buttons.

The Handwerker patent (U.S. Pat. No. 3,480,069) discloses a temporary wall construction for a building site. However, the wall requires grommets to secure a panel to an exterior surface of a building, and is not adaptive to secure a mesh panel to other objects.

The Nusbaum patent (U.S. Pat. No. 4,838,382) discloses a safety net that is raised during construction of a multi-floor building without the use of tracks vertically attached to the outer building face. However, the safety net extends from a surface of a building away there from, and is not a mesh panel that is secured onto existing structures and objects via a plurality of unique defined clips.

The Kinder patent (U.S. Pat. No. 4,928,929) discloses a safety netting for use at construction sites to prevent objects from falling from upper stories. However, the safety netting does not work in conjunction with uniquely shaped clips that attach onto existing surfaces and objects, and which attach the netting thereon.

The Johnson patent (U.S. Pat. No. 5,182,889) discloses a barrier system that is lightweight and exceeds existing safety regulations. However, the barrier system employs the use of a plurality of rod-like, elongated bodies to support the mesh as opposed to uniquely defined clips that attach onto existing structure and which attach to a mesh panel.

While the above-described devices fulfill their respective and particular objects and requirements, they do not describe a barricading system that can be installed on a temporary or permanent basis for use with a building or structure so as to prevent objects from falling off of an elevated surface or floor; wherein the barricading system includes a mesh panel that clips into a plurality of uniquely defined clips, which support said mesh on or against an object or surface; wherein the plurality of uniquely defined clips are adapted for use with tubular objects, curbed surfaces, elongated edges, or to abut adjacent sections of mesh panels at varying angles; wherein the uniquely defined clips each include an eccentric pin joiner and a mesh clip button that attach onto the uniquely defined clip and which sandwich the mesh panel therein so as to secure the mesh panel to the respective clip; wherein a removal tool is included to aid in detaching the clips from the mesh panels and/or related surfaces. In this regard, the safety barricading system departs from the conventional concepts and designs of the prior art.

SUMMARY OF THE INVENTION

The safety barricading system includes at least one mesh panel that is secured against an existing surface, object, or structure via a plurality of uniquely defined clips. The safety barricading system is designed to adaptively attach onto a building or structure in a temporary or permanent basis, and prevent objects from falling there from. The safety barricading system includes tools that remove the clips after use as well as joiner assemblies that abut adjacent sections of mesh panels at varying angles. The uniquely defined clips each include an eccentric pin joiner and mesh clip button that attach to one another as well as onto the respective clip, and sandwich the mesh panel there between so as to secure the mesh panel to the respective clip.

An object of the invention is to provide a barricading system that attaches onto existing objects, structures, or surfaces in order to span a mesh panel thereon for prevention of falling objects there from.

A further object of the invention is to provide a plurality of uniquely defined clips that can attach onto the existing object, structure, or surface, and provide a means for securing the mesh panel thereon.

An even further object of the invention is to provide eccentric pin joiners and mesh clip buttons that sandwich a small portion of the mesh panel and also secure the mesh panel to the respective uniquely defined clip.

A further object of the invention is to include a plurality of joiner assemblies that enable abutting sections of mesh panels to be secured to one another at a plurality of angles.

A further object of the invention is to provide a removal tool that aids in removing the uniquely defined clips from a tubular surface.

These together with additional objects, features and advantages of the safety barricading system will be readily apparent to those of ordinary skill in the art upon reading the following detailed description of presently preferred, but nonetheless illustrative, embodiments of the safety barricading system when taken in conjunction with the accompanying drawings.

In this respect, before explaining the current embodiments of the safety barricading system in detail, it is to be understood that the safety barricading system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the safety barricading system.

It is therefore important that the claims be regarded as including such equivalent construction insofar as they do not depart from the spirit and scope of the safety barricading system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
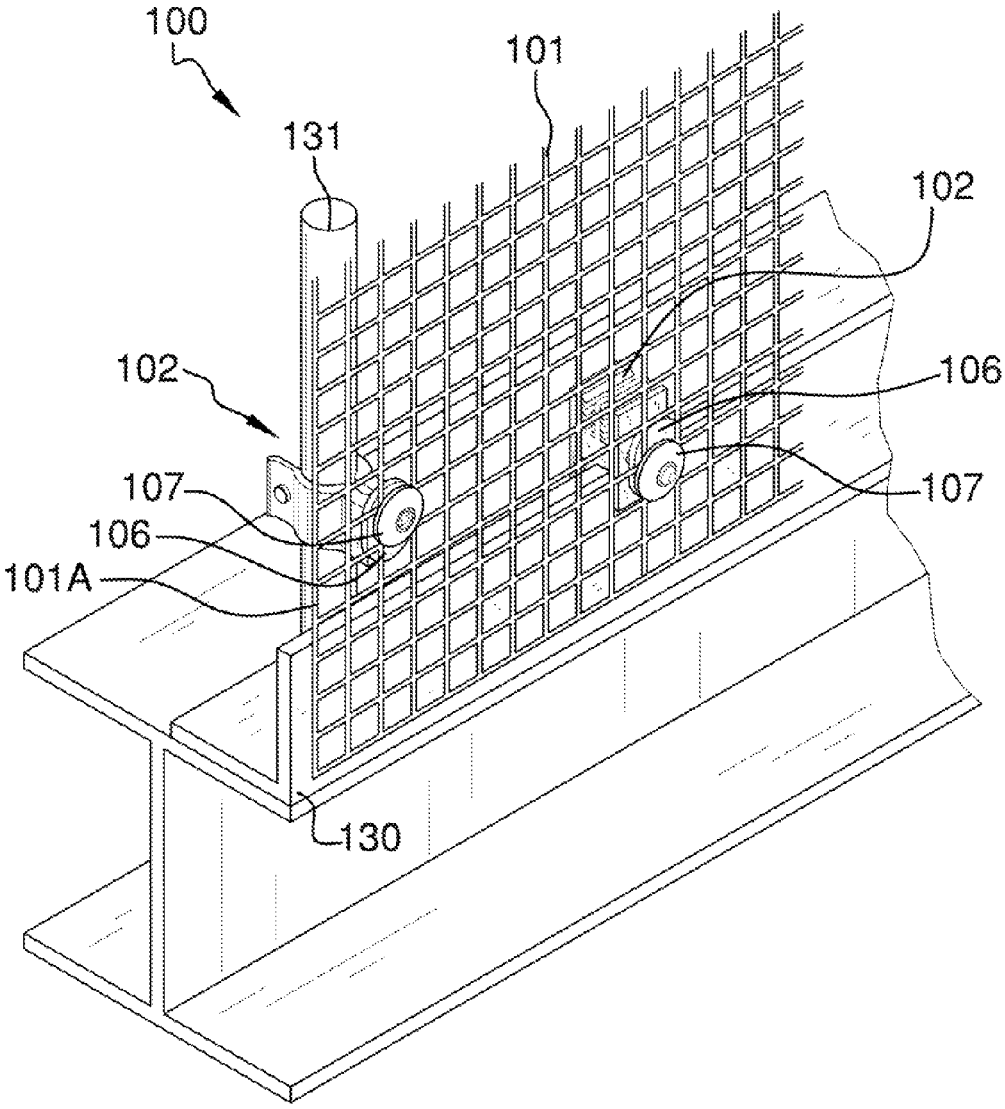
FIG. 1 illustrates a perspective view of the safety barricading system in which a mesh panel secured to an existing stanchion and handrail via two uniquely defined clips.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-10. A safety barricading system 100 (hereinafter invention) includes at least one mesh panel 101 and a plurality of uniquely defined clips 102. The invention 100 may employ a joiner assembly 103 provided the particular application of the invention 100 requires abutting sections of the mesh panel 101.

The mesh panel 101 is of an undefined height by an undefined width, and features a pattern therein, and which provides the protection desired to prevent objects from falling off of an elevated surface or structure when installed.

As mentioned earlier, the invention 100 may be installed on a permanent or temporary basis. The uniquely defined clips 102 attach the mesh panel(s) 101 to existing objects, structures, or surfaces. The uniquely defined clips 102 comprise a kick rail clip 104 and a tubular clip 105.

Figure 4:
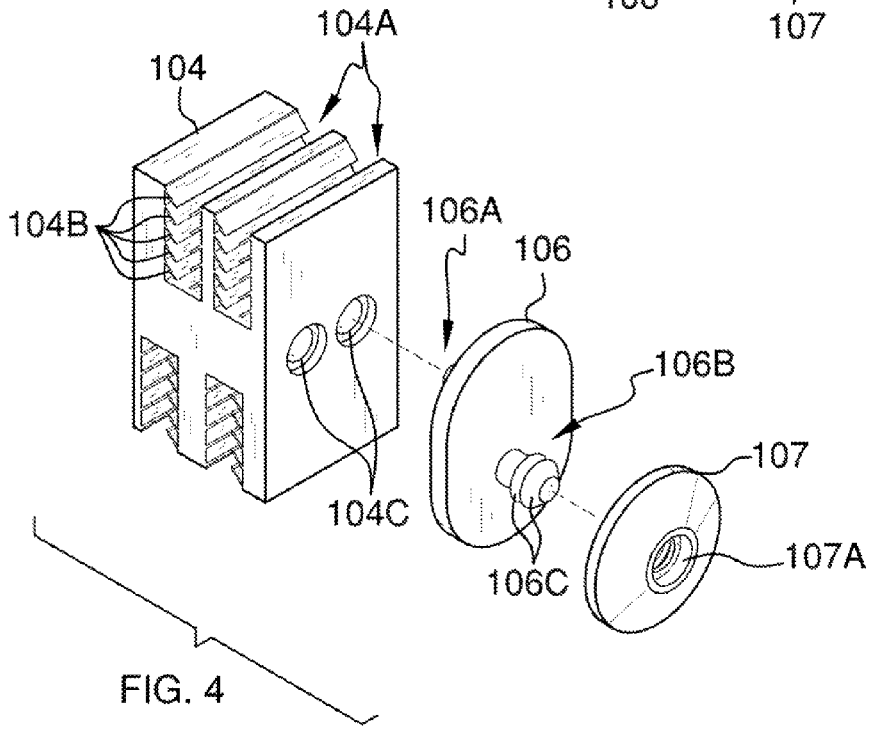
FIG. 4 illustrates a perspective view of another uniquely defined clip that includes a plurality of cavities thereon and which can engage either the mesh panel directly or an elongated surface.

Referring to FIGS. 1 and 4, the kick rail clip 104 is characterized by a plurality of cavities 104A that are generally parallel with one another, and which each include angled teeth 104B therein. The angled teeth 104B are presented at an angle such that upon insertion of a flattened or board-like object 130 therein, the angled teeth 104B will lock said object therein, and prevent reversal of said object from the respective cavity 104A. Referring to FIG. 1, the kick rail clip 104 is ideally used to grip onto the object 130, which is a kick plate, but may be used for any other board-like geometry.

The kick rail clip 104 includes a plurality of pin holes 104C, which are ideally located to enable attachment of an eccentric pin joiner 106 thereon.

The eccentric pin joiner 106 includes a first member 106A that extends perpendicularly with respect to the eccentric pin joiner 106. A second member 106B extends perpendicularly with respect to the eccentric pin joiner 106, and more particularly, the second member 106B extends in a diametrically opposed orientation with respect to the first member 106A. That being said, the first member 106A is generally parallel with respect to the second member 106B. The first member 106A is offset with respect to the second member 106B such that the first member 106A is not aligned with the second member 106B (see FIG. 9). Both the first member 106A and the second member 106B each have circular flanges 106C thereon, which are ideal for securement with the pin holes 104C of the kick rail clip 104 or with a mesh clip button 107.

The mesh clip button 107 is a circular disc having a member hole 107A concentrically aligned, and which is used to attach the mesh clip button 107 onto either the first member 106A or the second member 106B of the eccentric pin joiner 106.

The mesh clip button 107 and the eccentric pin joiner 106 are used to sandwich and secure a portion of a mesh panel 101 there between, and to attach to the uniquely shaped clip 102.

The tubular clip 105 is designed to secure the mesh panel 101 against a tubular surface 131, such as a handrail (see FIGS. 1 and 8-10). The tubular clip 105 includes two arms 105A that extend away from one another. The two arms 105A mirror one another, and form a cylindrical opening 105B into which the tubular surface 131 is inserted when in use. It shall be noted that the tubular clip 105 and the cylindrical opening 105B may be scaled up or down to accommodate differently sized tubular surfaces 131.

Both of the arms 105A include a pin hole 105C that enables a pin 105D to slide there between and enclose the tubular surface 131 therein. The pin 105D includes circular flanges 105E that are analogous to the circular flanges 106C of the first member 106A and the second member 106B of the eccentric pin joiner 106. The pin 105D includes a shoulder 105F, which works with the circular flanges 105E to secure the pin 1050 to the two arms 105A.

The tubular clip 105 also includes at least one eccentric pin hole 105G, which works in the same manner as the pin hole 104C of the kick rail clip 104 in order to secure the eccentric pin joiner 106 thereon.

Figure 2:
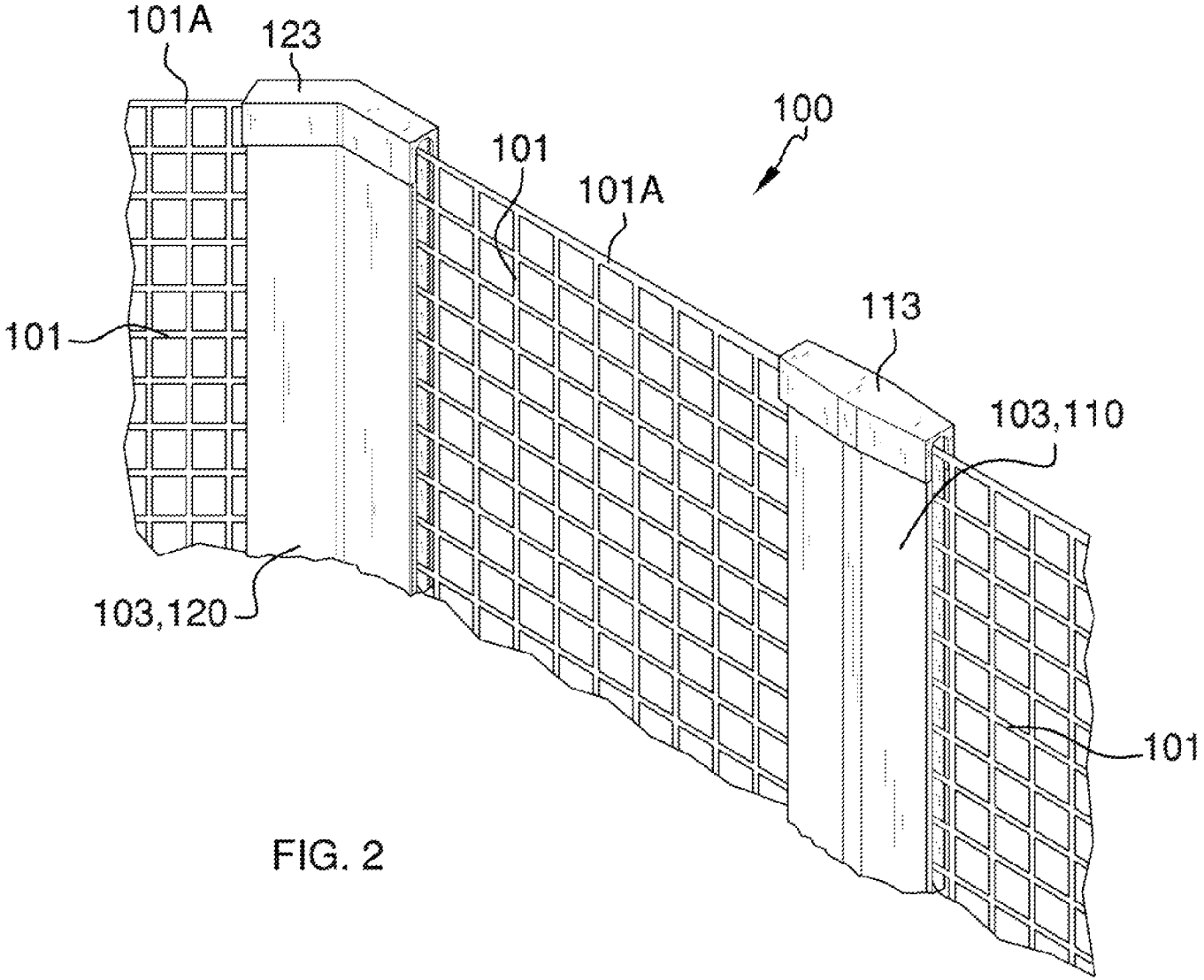
FIG. 2 illustrates a perspective view of multiple adjacent sections of mesh panels that are secured to one another via different joiner assemblies.
Figure 3:
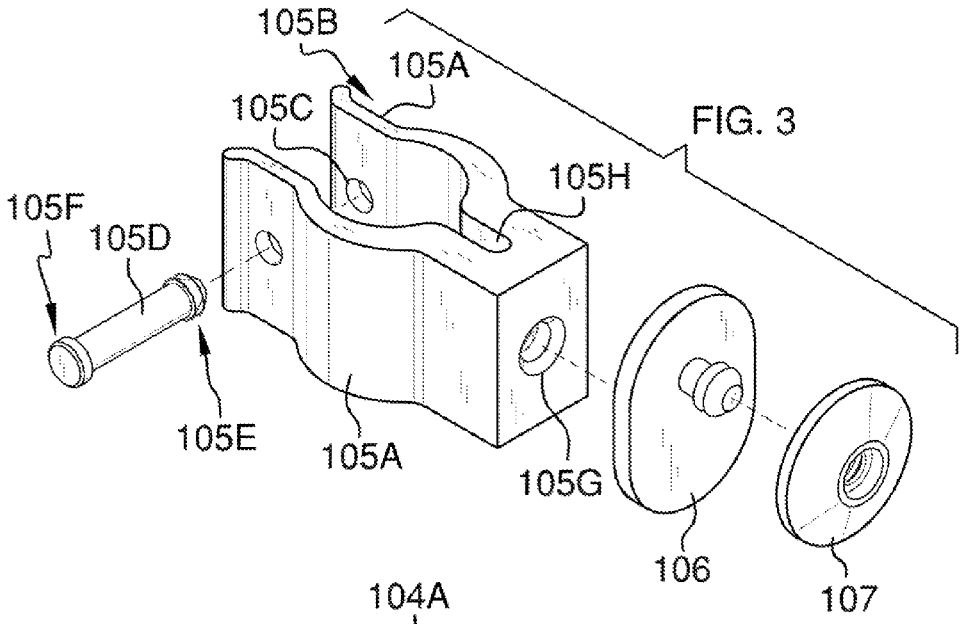
FIG. 3 illustrates a perspective view of a uniquely defined clip that includes the eccentric pin joiner and mesh clip button exploded there from as well as a locking pin, and which is ideally used with objects having circular cross-sections.
Figure 5:
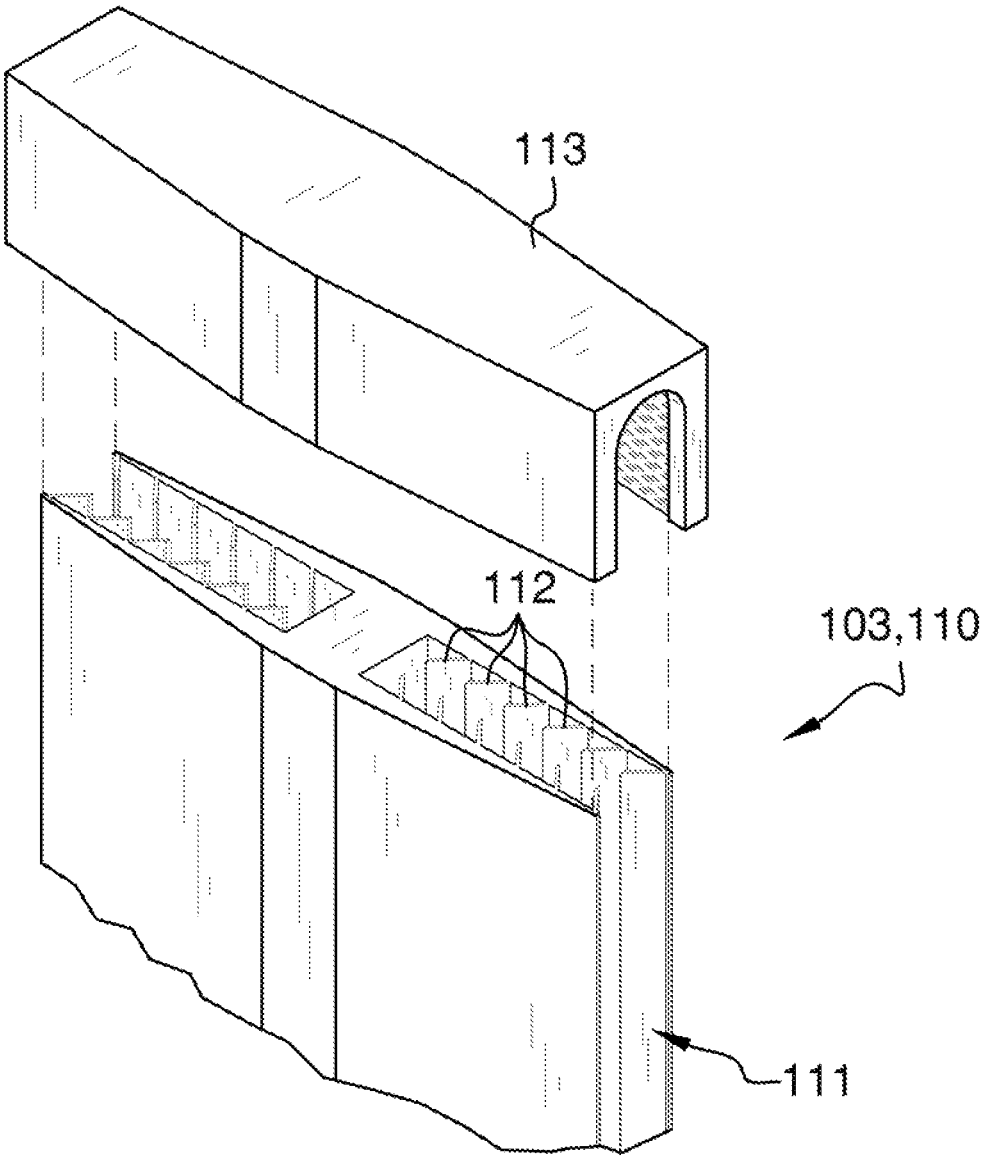
FIG. 5 illustrates a perspective view of a joiner assembly in which a cap is exploded therefrom and in which is ideally suited for securing adjacent mesh panels at a 180-degree orientation.

As mentioned earlier, the invention 100 may include joiner assemblies 103 to secure adjacent sections of the mesh panels 101. Referring to FIGS. 2 and 5, a vertical joiner assembly 110 includes two cavities 111 that extend in a diametrically opposed fashion from one another. The vertical joiner assembly 110 is of an undefined length, and in which the two cavities 111 span said undefined length. The cavities 111 include angled teeth 112 therein, which are oriented at an angle in order to grab and secure an edge 101A of the mesh panel 101 therein. The teeth 112 work in a manner consistent with the angled teeth 104B of the kick rail clip 104 described above. The vertical joiner assembly 110 includes a cap 113 that clips onto an end of the vertical joiner assembly 110 so as to enclose off side profiled openings of the cavities 111.

Figure 6:
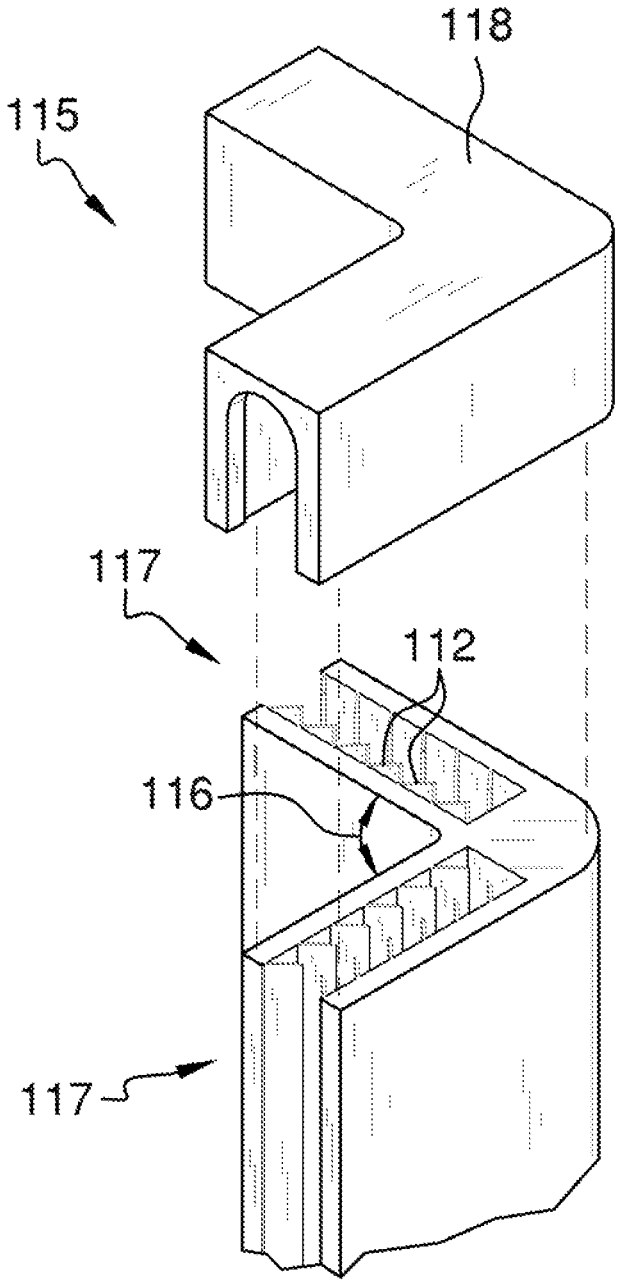
FIG. 6 illustrates a perspective view of a joiner assembly in which a cap is exploded therefrom and in which is ideally suited for securing adjacent mesh panels at a 90-degree orientation.

Referring to FIG. 6, the invention 100 may employ the use of a corner joiner assembly 115, which is of an undefined length and features a 90-degree angle 116 that is formed between two cavities 117. The cavities 117 feature the angled teeth 112 described above in regards to the vertical joiner assembly 110. The corner joiner assembly 115 includes a cap 118, which works in the same manner as the cap 113 described above.

Figure 7:
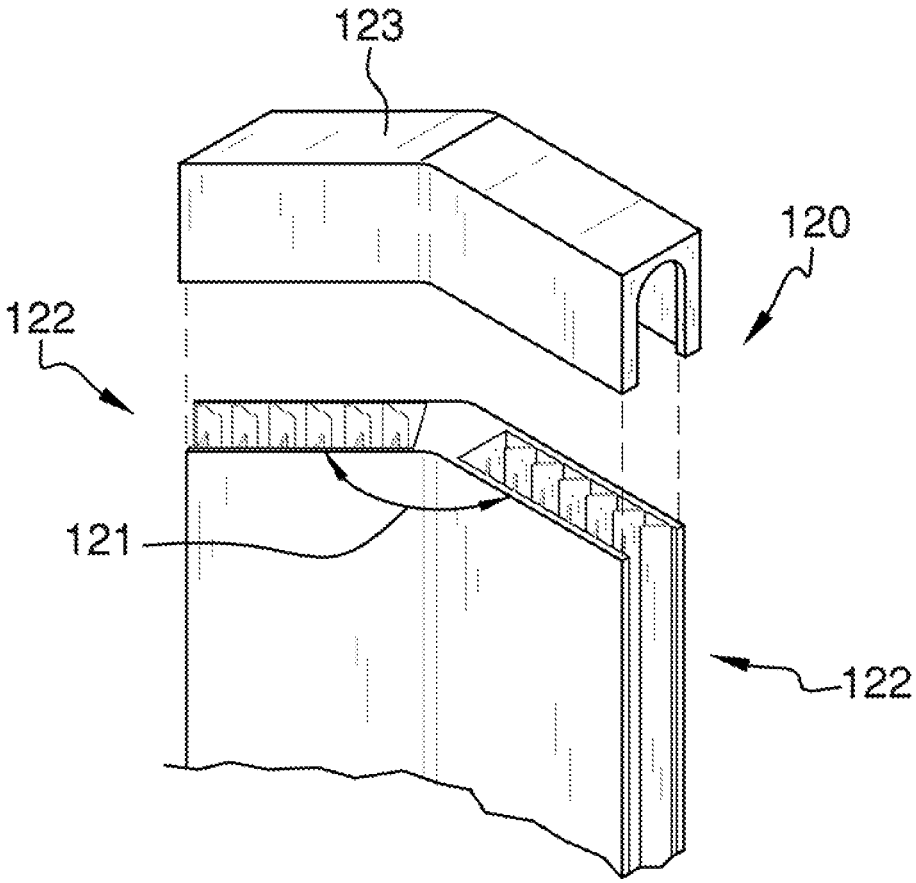
FIG. 7 illustrates a perspective view of a joiner assembly in which is cap is exploded therefrom and in which is ideally suited for securing adjacent mesh panels at an obtrusive angular orientation.

Referring to FIG. 7, the invention 100 may employ the use of an obtuse joiner assembly 120, which is of an undefined length and features an obtuse angle 121 that is formed between two cavities 122. The cavities 122 feature the angled teeth 112 described above in regards to the vertical joiner assembly 110. The obtuse joiner assembly 120 includes a cap 123, which works in the same manner as the cap 113 described above.

The joiner assemblies 103 (the vertical joiner assembly 110, the corner joint assembly 115, and the obtuse joiner assembly 120) all provide the same function which is to secure adjacent sections of the mesh panels 101 together, but differ with respect to one another in the angles formed between the respective cavities.

Figure 8:
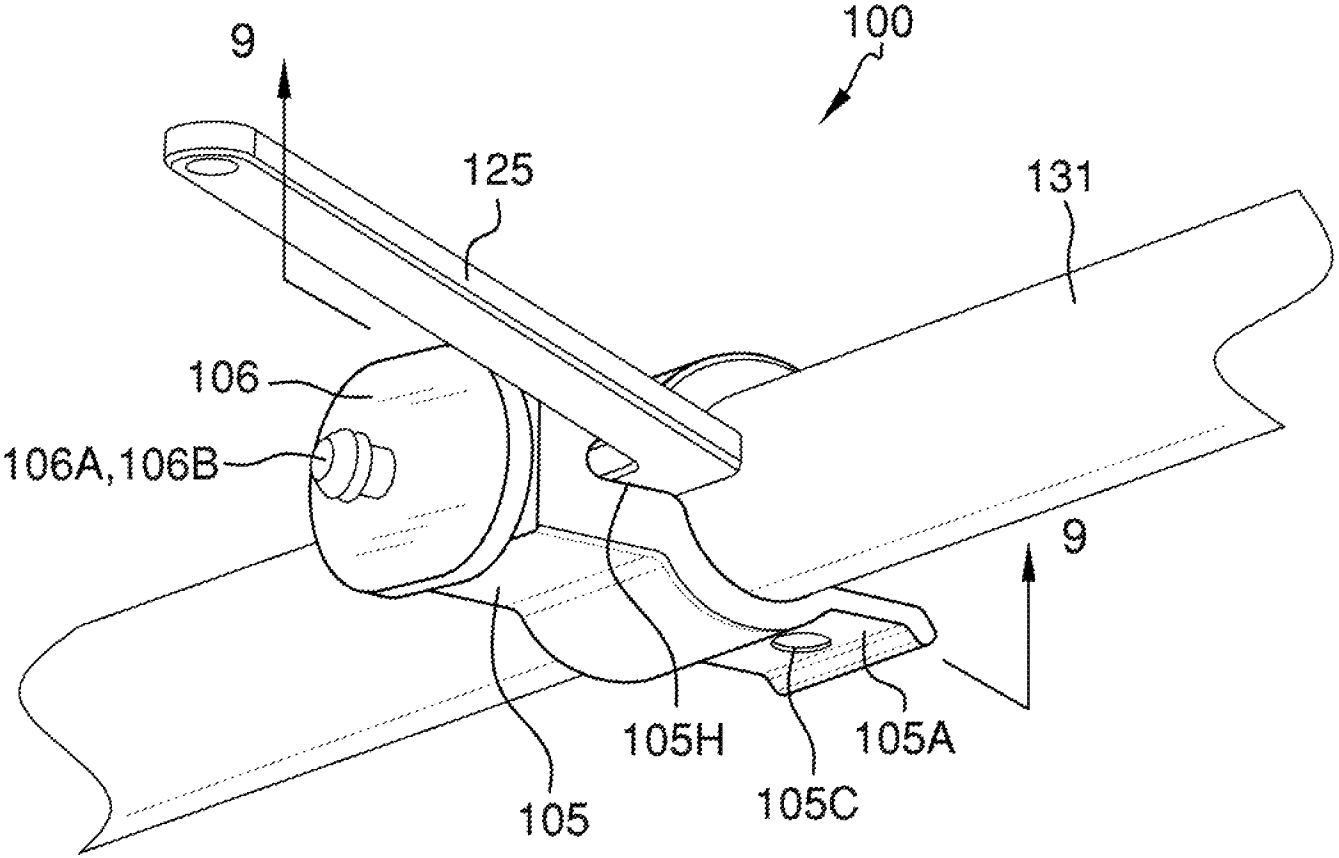
FIG. 8 illustrates a perspective view of the uniquely defined clip depicted in FIG. 3, and in which a removal tool is inserted therein.
Figure 9:
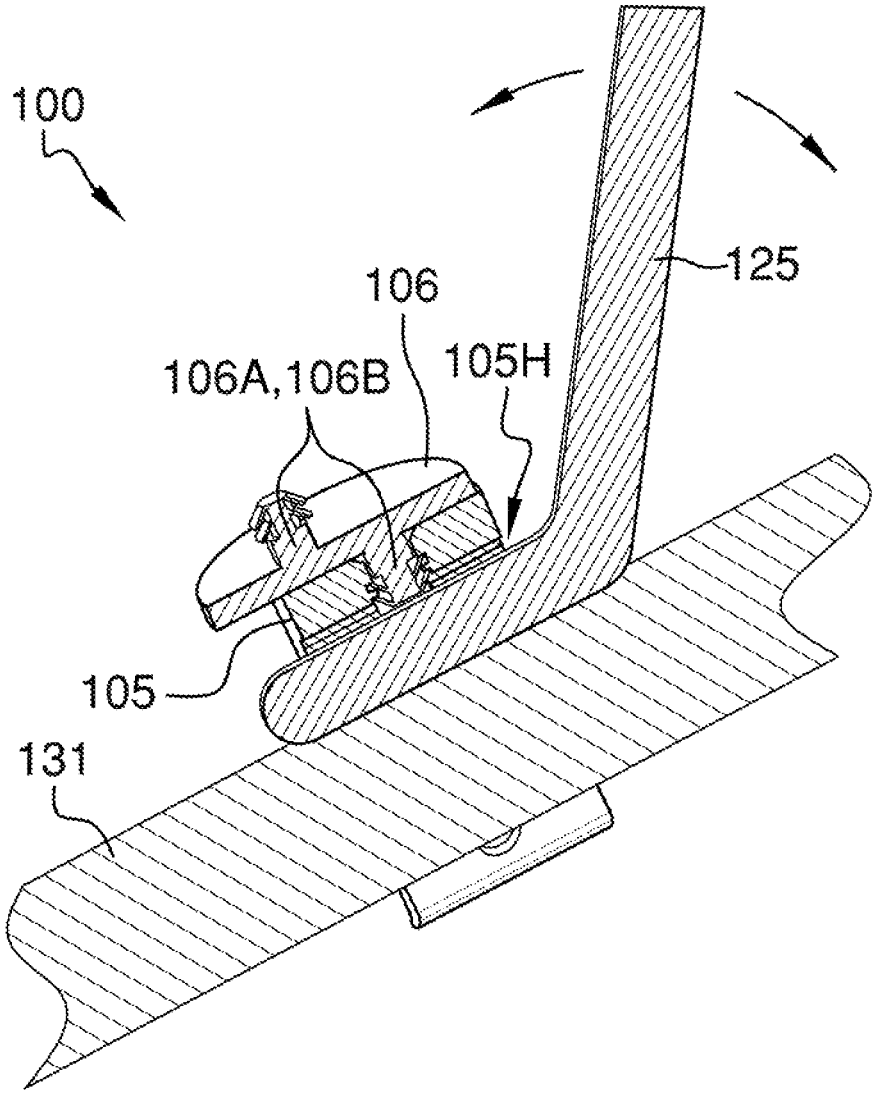
FIG. 9 illustrates a perspective view of the uniquely defined clip along line 9-9 in FIG. 8, and providing a rotational arrow indicating rotation of the removal tool thereby disengaging the respective clip from the tubular surface.
Figure 10:
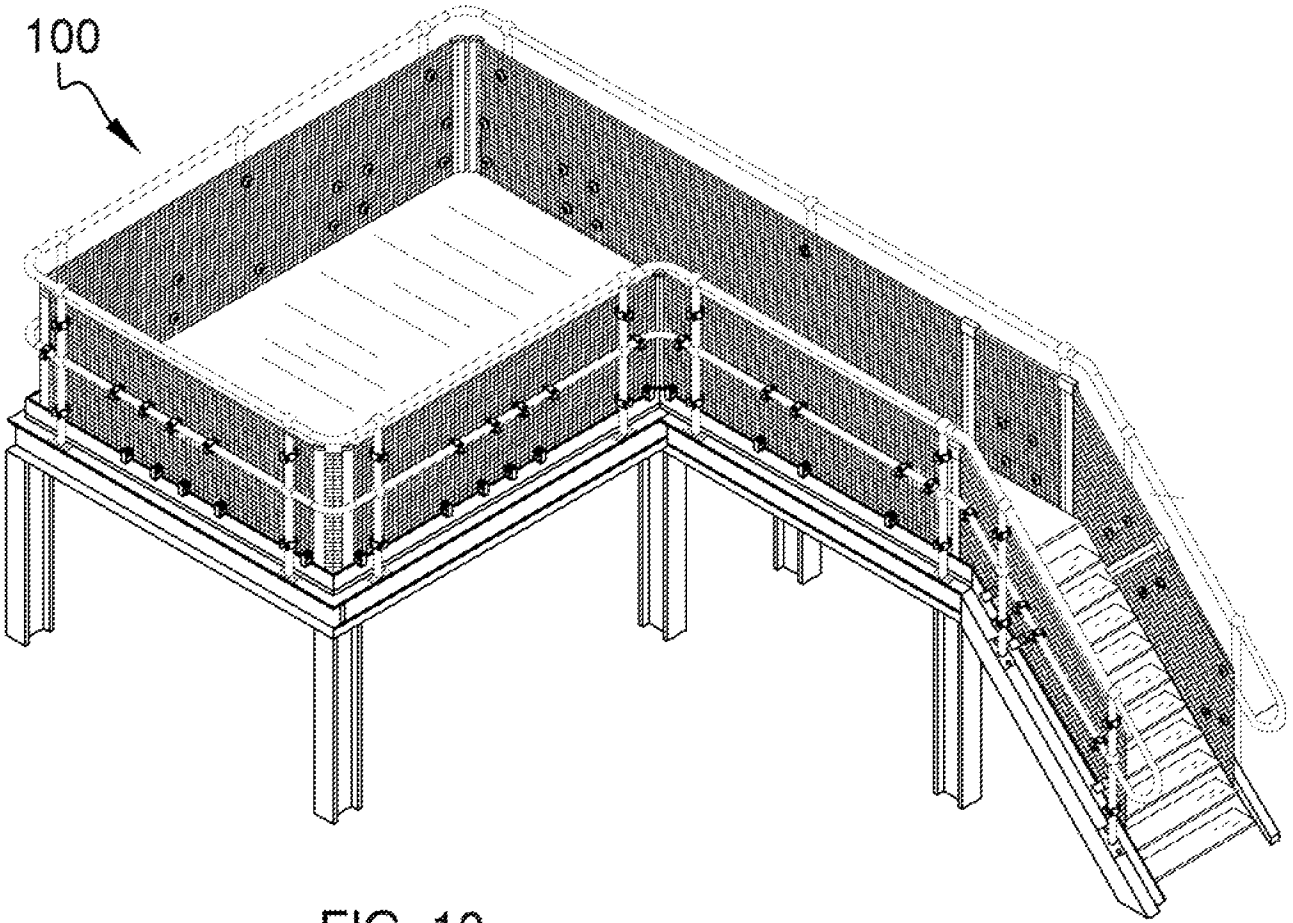
FIG. 10 illustrates a perspective view of the safety barricading system installed upon a handrail of an elevated platform and stairway.

Referring to FIGS. 8 and 9, the tubular clip 105 includes a notch 105H that is located at the base of the two arms 105A, and more importantly, is located between the two arms 105A. The notch 105H enables a removal tool 125 to be inserted therein, and pry loose the tubular clip 105 form the tubular surface 131.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A safety barricading system comprising:

at least one mesh panel of an undefined length;

at least one clip used to attach at least one such mesh panel to one or more existing mounting objects, each such clip being tubular and including two arms that extend away from one another and mirror one another, the two arms forming a cylindrical opening into which a mounting object is inserted when in use;

at least one eccentric pin joiner, each eccentric pin joiner attaching to a respective one of the at least one clip; and at least one mesh clip button, each such mesh clip button attachable to at least a respective one of the at least one eccentric pin joiner, each such clip sandwiching a portion of the at least one such mesh panel between a respective one of the at least one eccentric pin joiner and a respective one of the at least one mesh clip button;

wherein each eccentric pin joiner includes a first member that extends perpendicularly with respect to the respective eccentric pin joiner, and a second member that extends perpendicularly with respect to the respective eccentric pin joiner and in a diametrically opposed orientation with respect to the first member, the first member being generally parallel with respect to the second member and offset with respect to the second member such that the first member is not aligned with the second member, each of the first member and the second member being attached in or onto one of the mesh clip button or clip respectively.

2. The safety barricading system as described in claim 1, further comprising a kick rail clip that includes a plurality of cavities that are generally parallel with one another, and which each include angled teeth therein, the angled teeth being presented at an angle such that upon insertion of an object therein, the angled teeth will lock said object therein and prevent reversal of said object from the respective cavity.

3. The safety barricading system as described in claim 2 wherein the kick rail clip includes a plurality of pin holes, which enable attachment of a respective eccentric pin joiner thereon.

4. The safety barricading system as described in claim 3 wherein both of the arms include a pin hole that enables a pin to slide there between and enclose at least one such mounting object therein.

5. The safety barricading system as described in claim 1, wherein the at least one clip includes a notch that is located at the base of the two arms, the notch being located between the two arms, the notch enabling a removal tool to be inserted therein, and pry loose such clip from at least one such mounting object.

6. The safety barricading system as described in claim 1, wherein the at least one clip also includes at least one pin hole configured to receive the first member or second member of a respective one of the at least one eccentric pin joiner.

7. The safety barricading system as described in claim 5, wherein both the first member and the second member each have circular flanges thereon, which are ideal for securement with the pin holes of the kick rail clip or the eccentric pin hole of the tubular clip or with the mesh clip button.

8. The safety barricading system as described in claim 7, wherein the at least one mesh clip button is a circular disc having a member hole concentrically aligned, and which is used to attach such mesh clip button onto either the first member or the second member of a respective one of the at least one eccentric pin joiner.

9. The safety barricading system as described in claim 1 including multiple mesh panels, wherein a joiner assembly is included to secure adjacent sections of two such mesh panels to one another.

10. The safety barricading system as described in claim 9, wherein a vertical joiner assembly is provided and secures adjacent sections of two such mesh panels at a 180-degree orientation with respect to one another;

a corner joint assembly is provided and secures adjacent sections of two such mesh panels at a 90-degree orientation with respect to one another; and an obtuse joiner assembly is provided and secures adjacent sections of two such mesh panels at an obtuse angle with respect to one another.

11. A safety barricading system comprising:

at least one mesh panel of an undefined length;

at least one clip which is used to attach the at least one mesh panel to one or more existing objects; and at least one eccentric pin joiner and at least one mesh clip button, each such eccentric pin joiner attaching onto a respective such clip, a respective such mesh clip button sandwiching a portion of a respective such mesh panel between the respective such mesh clip button and the respective such eccentric pin joiner;

wherein the at least one clip comprises at least one of a kick rail clip and a tubular clip, such kick rail clip including a plurality of cavities that are generally parallel with one another, and which each include angled teeth therein, the angled teeth being presented at an angle such that upon insertion of at least one such existing object therein, the angled teeth lock said mounting object therein, and prevent reversal of said at least one such existing object from the respective cavity; the kick rail clip also including a plurality of pin holes, which enable attachment of at least one of the at least one eccentric pin joiner thereon;

such tubular clip including two arms that extend away from one another and mirror one another, the two arms forming a cylindrical opening into which at least one such existing object is inserted when in use; each arm including a pin hole that enables a pin to slide there between and enclose the at least one such existing object therein; the tubular clip also including a notch that is located at the base of the two arms and in between the two arms, the notch enabling a removal tool to be inserted therein, and pry loose the tubular clip from the mounting object; the tubular clip also including at least one pin hole configured to receive the first member or second member of the eccentric pin joiner; and wherein each such eccentric pin joiner includes a first member that extends perpendicularly with respect to the respective eccentric pin joiner and a second member that extends perpendicularly with respect to the respective eccentric pin joiner and in a diametrically opposed orientation with respect to the first member, the first member being generally parallel and offset with respect to the second member such that the first member is not aligned with the second member, both the first member and the second member each have circular flanges thereon configured for securement with at least one of the pin holes of a respective such kick rail clip or the eccentric pin hole of a respective such tubular clip or with a respective such mesh clip button.

12. The safety barricading system as described in claim 11, wherein a respective such mesh clip button is circular.

13. The safety barricading system as described in claim 12, having multiple mesh panels and wherein a vertical joiner assembly is provided and secures adjacent sections of two such mesh panels at a 180-degree orientation with respect to one another;

a corner joint assembly is provided and secures adjacent sections of two such mesh panels at a 90-degree orientation with respect to one another; and an obtuse joiner assembly is provided and secures adjacent sections of two such mesh panels at an obtuse angle with respect to one another.

* * * * *